US007469972B2

(12) United States Patent
Hall et al.

(10) Patent No.: US 7,469,972 B2
(45) Date of Patent: Dec. 30, 2008

(54) WEAR RESISTANT TOOL

(76) Inventors: David R. Hall, 2185 S. Larsen Pkwy., Provo, UT (US) 84606; Ron Crockett, 2185 S. Larsen Pkwy., Provo, UT (US) 84606; Jeff Jepson, 2185 S. Larsen Pkwy., Provo, UT (US) 84606; Joe Fox, 2185 S. Larsen Pkwy., Provo, UT (US) 84606; Michael Barnhill, 2185 S. Larsen Pkwy., Provo, UT (US) 84606

( * ) Notice: Subject to any disclaimer, the term of this patent is extended or adjusted under 35 U.S.C. 154(b) by 0 days.

(21) Appl. No.: 11/424,825

(22) Filed: Jun. 16, 2006

(65) Prior Publication Data

US 2007/0290546 A1 Dec. 20, 2007

(51) Int. Cl.
*E21C 35/18* (2006.01)
*E21C 35/183* (2006.01)

(52) U.S. Cl. ..... 299/110; 174/433

(58) Field of Classification Search ..... 299/102–107, 299/110, 111, 113; 175/425–435
See application file for complete search history.

(56) References Cited

U.S. PATENT DOCUMENTS

| | | | |
|---|---|---|---|
| 2,004,315 | A | 6/1935 | Fean |
| 2,124,438 | A | 7/1938 | Struk |
| 3,254,392 | A | 6/1966 | Novkov |
| 3,746,396 | A | 7/1973 | Radd |
| 3,807,804 | A | 4/1974 | Kniff |
| 3,932,952 | A | 1/1976 | Helton |
| 3,945,681 | A | 3/1976 | White |
| 4,005,914 | A | 2/1977 | Newman |
| 4,006,936 | A | 2/1977 | Crabiel |
| 4,098,362 | A | 7/1978 | Bonnice |
| 4,109,737 | A | 8/1978 | Bovenkerk |
| 4,156,329 | A | 5/1979 | Daniels |
| 4,199,035 | A | 4/1980 | Thompson |
| 4,201,421 | A | 5/1980 | Den Besten |
| 4,277,106 | A | 7/1981 | Sahley |
| 4,439,250 | A | 3/1984 | Acharya |

(Continued)

FOREIGN PATENT DOCUMENTS

DE 3431888 A1 * 3/1985

(Continued)

OTHER PUBLICATIONS

Translation of JP 08100589, pp. 1-6, retrieved date Apr. 24, 2008.*

(Continued)

*Primary Examiner*—Sunil Singh
(74) *Attorney, Agent, or Firm*—Tyson J. Wilde

(57) ABSTRACT

In one aspect of the invention, a wear-resistant tool is disclosed which may comprise first and second cemented metal carbide segments chemically bonded together at an interface. The first segment may comprise a first coefficient of thermal expansion (CTE) at least at its interfacial surface and the second segment may comprise a second CTE at least at its interfacial surface less than the CTE of the first segment. The first segment may further comprise a cross-sectional thickness substantially equal to or greater than a cross-sectional thickness of the second segment at the interface.

15 Claims, 12 Drawing Sheets

U.S. PATENT DOCUMENTS 4,465,221 A 8/1984 Schmidt
4,484,644 A 11/1984 Cook
4,489,986 A 12/1984 Dziak
4,678,237 A 7/1987 Collin
4,682,987 A 7/1987 Brady
4,688,856 A 8/1987 Elfgen
4,702,525 A * 10/1987 Sollami et al. ..... 299/111
4,725,098 A 2/1988 Beach
4,729,603 A 3/1988 Elfgen
4,765,686 A 8/1988 Adams
4,765,687 A 8/1988 Parrott
4,776,862 A 10/1988 Wiand
4,880,154 A 11/1989 Tank
4,940,288 A 7/1990 Stiffler
4,944,559 A 7/1990 Sionnet
4,951,762 A 8/1990 Lundell
5,011,515 A 4/1991 Frushour
5,112,165 A 5/1992 Hedlund
5,141,289 A 8/1992 Stiffler
5,154,245 A 10/1992 Waldenstrom
5,186,892 A 2/1993 Pope
5,251,964 A 10/1993 Ojanen
5,332,348 A 7/1994 Lemelson
5,417,475 A 5/1995 Graham
5,447,208 A 9/1995 Lund
5,535,839 A 7/1996 Brady
5,542,993 A 8/1996 Rabinkin
5,653,300 A 8/1997 Lund
5,738,698 A 4/1998 Kapoor
5,823,632 A 10/1998 Burkett
5,837,071 A 11/1998 Andersson
5,845,547 A 12/1998 Sollami
5,875,862 A 3/1999 Jurewicz
5,934,542 A 8/1999 Nakamura
5,935,718 A 8/1999 Demo
5,944,129 A 8/1999 Jensen
5,967,250 A 10/1999 Lund
5,992,405 A 11/1999 Sollami
6,006,846 A 12/1999 Tibbitts
6,019,434 A 2/2000 Emmerich
6,044,920 A * 4/2000 Massa et al. ..... 175/417
6,051,079 A 4/2000 Andersson
6,056,911 A 5/2000 Griffin
6,065,552 A 5/2000 Scott
6,113,195 A 9/2000 Mercier
6,170,917 B1 1/2001 Heinrich
6,193,770 B1 2/2001 Sung
6,196,636 B1 3/2001 Mills
6,196,910 B1 3/2001 Johnson
6,199,956 B1 3/2001 Kammerer
6,216,805 B1 4/2001 Lays
6,270,165 B1 8/2001 Peay
6,341,823 B1 1/2002 Sollami
6,354,771 B1 3/2002 Bauschulte
6,364,420 B1 4/2002 Sollami
6,371,567 B1 4/2002 Sollami
6,375,272 B1 4/2002 Ojanen
6,419,278 B1 7/2002 Cunningham
6,478,383 B1 11/2002 Ojanen
6,499,547 B2 12/2002 Scott
6,517,902 B2 2/2003 Drake
6,585,326 B2 7/2003 Sollami
6,685,273 B1 2/2004 Sollami
6,709,065 B2 3/2004 Peay
6,719,074 B2 4/2004 Tsuda
6,733,087 B2 5/2004 Hall
6,739,327 B2 5/2004 Sollami
6,758,530 B2 7/2004 Sollami
6,824,225 B2 11/2004 Stiffler
6,861,137 B2 3/2005 Hughes
6,889,890 B2 5/2005 Yamazaki
6,966,611 B1 11/2005 Sollami
6,994,404 B1 2/2006 Sollami
7,204,560 B2 4/2007 Mercier
2001/0008190 A1 * 7/2001 Scott et al. ..... 175/374
2003/0051924 A1 * 3/2003 Tsuda et al. ..... 175/426
2003/0140350 A1 7/2003 Noro
2003/0209366 A1 11/2003 McAlvain
2003/0234280 A1 12/2003 Cadden
2004/0026983 A1 2/2004 McAlvain
2004/0065484 A1 4/2004 McAlvain
2005/0159840 A1 7/2005 Lin
2006/0237236 A1 * 10/2006 Sreshta et al. ..... 175/426

FOREIGN PATENT DOCUMENTS

EP 412287 A2 * 2/1991
JP 08100589 A * 4/1996
JP 2896749 B2 * 5/1999
RU 2263212 C1 * 10/2005
WO WO 9728353 A1 * 8/1997

OTHER PUBLICATIONS

Translation of JP 08100589 abstract, p. 1, retrieved date Apr. 25, 2008.*

* cited by examiner

WEAR RESISTANT TOOL

BACKGROUND OF THE INVENTION

Efficient degradation of materials is important to a variety of industries including the asphalt, mining, and excavation industries. In the asphalt industry, pavement may be degraded using attack tools, and in the mining industry, attack tools may be used to break minerals and rocks. Attack tools may be used when excavating large amounts of hard materials. In the asphalt recycling industry, often, a drum with an array of attack tools attached to it may be rotated and moved so that the attack tools engage a paved surface to be degraded. Because attack tools engage materials that may be abrasive, the attack tools may be susceptible to wear. One development disclosed in the patent art for reducing wear of the attack tool, is to add a polycrystalline diamond layer to the tip of the tool.

U.S. Pat. No. 6,733,087 to Hall et al., which is herein incorporated by reference for all that it contains, discloses an attack tool for working natural and man-made materials that is made up of one or more segments, including a steel alloy base segment, an intermediate carbide wear protector segment, and a penetrator segment comprising a carbide substrate that is coated with a superhard material. The segments are joined at continuously curved interfacial surfaces that may be interrupted by grooves, ridges, protrusions, and posts. At least a portion of the curved surfaces vary from one another at about their apex in order to accommodate ease of manufacturing and to concentrate the bonding material in the region of greatest variance.

BRIEF SUMMARY OF THE INVENTION

In one aspect of the invention, a wear-resistant tool comprises first and second cemented metal carbide segments chemically bonded together at an interface. The first segment comprises a first coefficient of thermal expansion (CTE) at least at its interfacial surface and the second segment comprises a second CTE at least at its interfacial surface, the second CTE being less than the CTE of the first segment. The first segment further comprises a cross-sectional thickness greater than a cross-sectional thickness of the second segment at the interface. In another aspect of the invention, the interface may be held under compression by a material comprising a higher CTE than the CTE of the second segment.

DETAILED DESCRIPTION OF THE INVENTION AND THE PREFERRED EMBODIMENT

It will be readily understood that the components of the present invention, as generally described and illustrated in the Figures herein, may be arranged and designed in a wide variety of different configurations. Thus, the following more detailed description of embodiments of the methods of the present invention, as represented in the Figures is not intended to limit the scope of the invention, as claimed, but is merely representative of various selected embodiments of the invention.

The illustrated embodiments of the invention will best be understood by reference to the drawings, wherein like parts are designated by like numerals throughout. Those of ordinary skill in the art will, of course, appreciate that various modifications to the methods described herein may easily be made without departing from the essential characteristics of the invention, as described in connection with the Figures. Thus, the following description of the Figures is intended only by way of example, and simply illustrates certain selected embodiments consistent with the invention as claimed herein.

Figure 1:
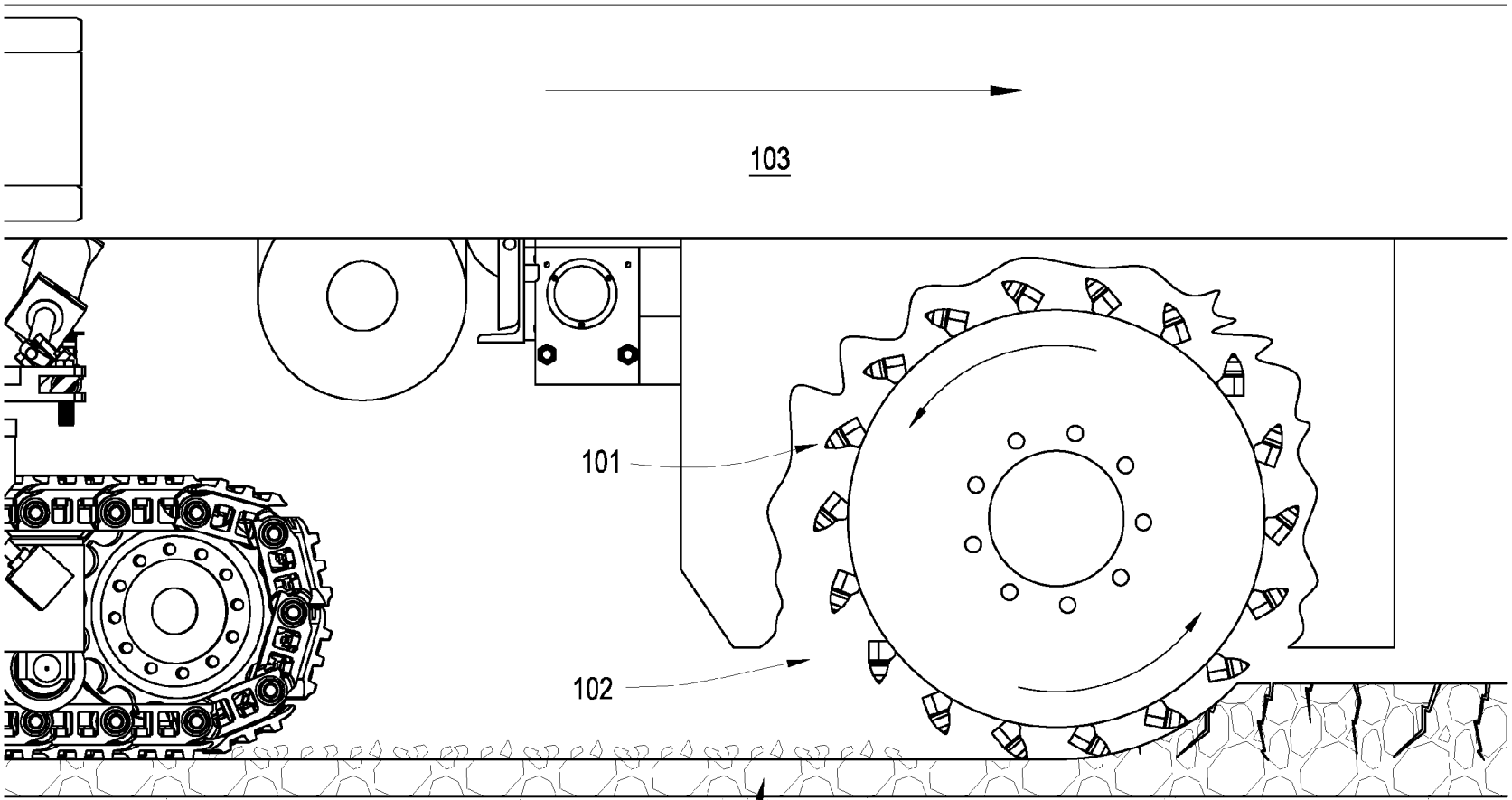
FIG. 1 is a cross-sectional diagram of an embodiment of tools on a rotating drum attached to a motor vehicle.

FIG. 1 is a cross-sectional diagram of an embodiment of an attack tool 101 on a rotating drum 102 attached to a motor vehicle 103. The motor vehicle 103 may be a cold planer used to degrade pavement 104 prior to the placement of a new layer of pavement or a mining vehicle used to degrade natural formations. Tools 101 may be attached to a drum 102 which rotates so the tools 101 engage a formation. The formation that the tool 101 engages may be abrasive such that it may cause substantial wear on tools 101. The wear-resistant tool 101 may be selected from the group consisting of drill bits, asphalt picks, mining picks, hammers, indenters, shear cutters, indexable cutters, and combinations thereof. In large operations, such as pavement degradation, when tools 101 need to be replaced the entire operation may cease while crews remove worn tools 101 and replace them with new tools 101. The time spent replacing tools 101 may be especially unproductive and costly.

Figure 2:
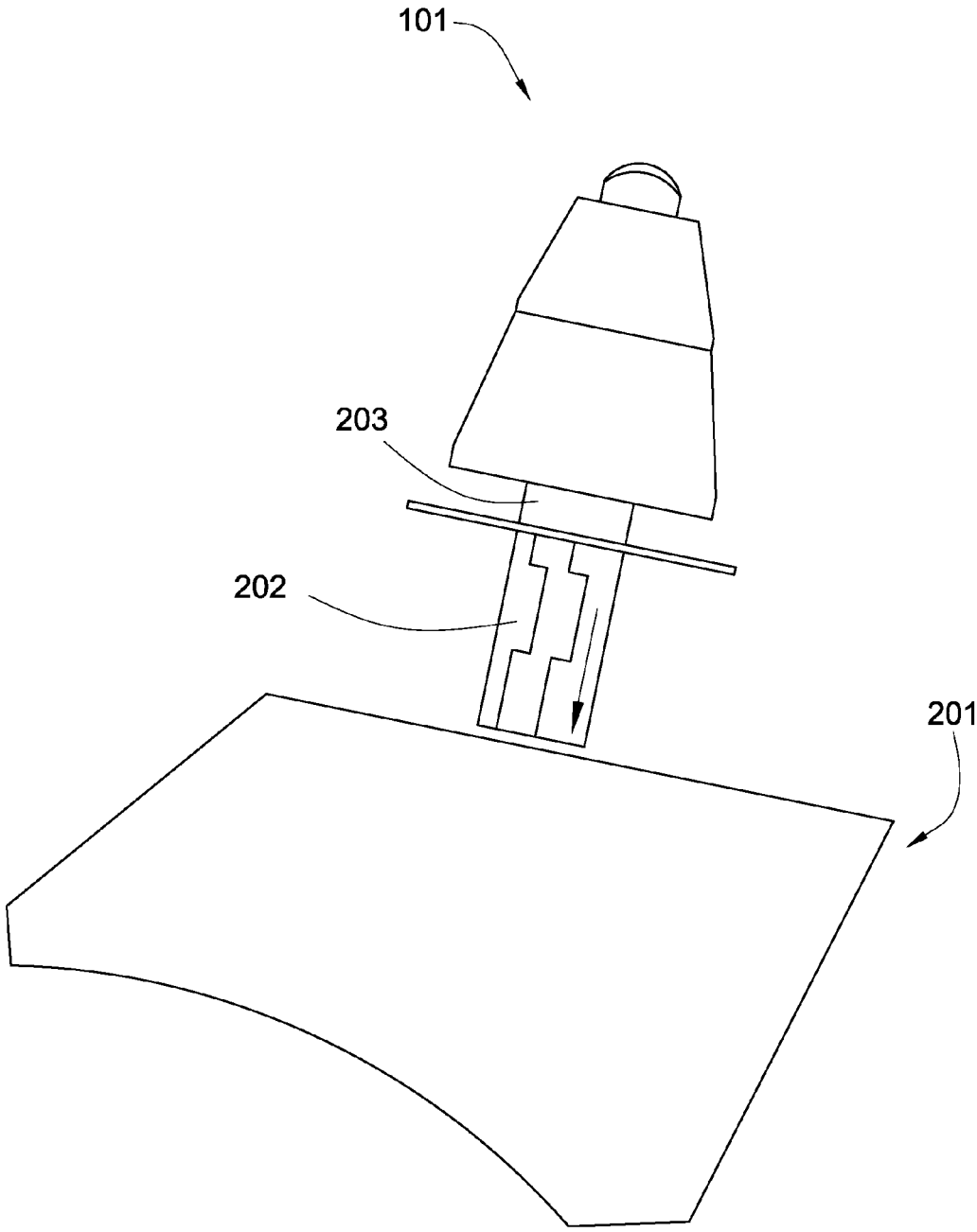
FIG. 2 is an orthogonal diagram of an embodiment of a tool and a holder.

FIG. 2 is an orthogonal diagram of an embodiment of an attack tool 101 secured within a holder 201. The holder 201 may be secured to the driving mechanism. The holder 201 may hold the tool 101 at an angle to increase the tool's 101 degradation efficiency. An end of the tool may comprise an attachment 203, such as a shaft, which may be secured within the holder 201. The holder 201 may support the attack tool 101 at an angle offset from the direction of rotation, such that as the tool engages the paved surface that the attack tool 101 rotates within the holder 201. A sheath 202 may be fitted around the shaft to enable or improve the tool's rotation. Rotation may be beneficial in that it may result in more even wear on the tool 101 instead of having most of the wear concentrated on one side of the tool 101.

Figure 3:
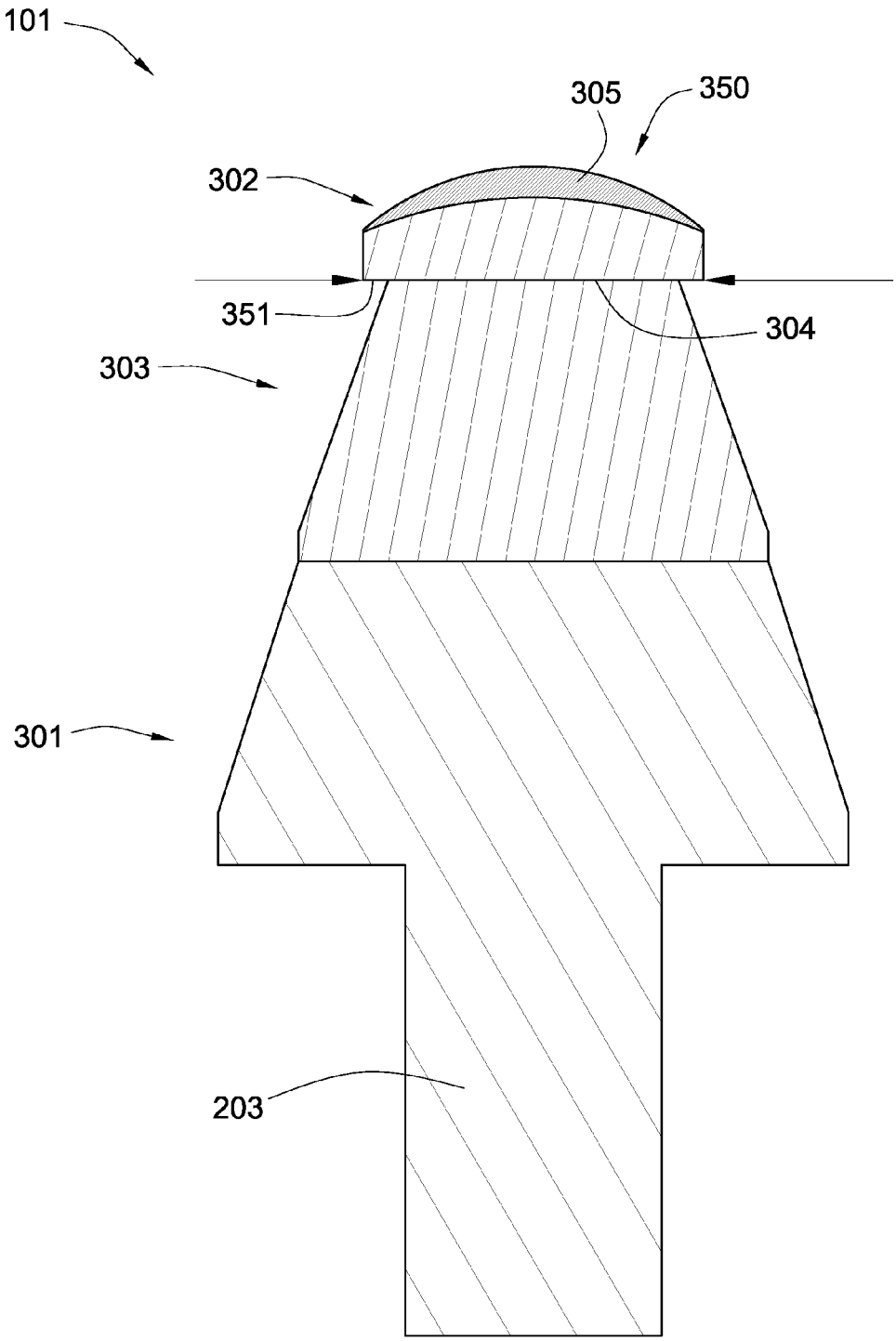
FIG. 3 is a cross-sectional diagram of an embodiment of a tool with the first segment comprising the tip of the tool.

FIG. 3 is a cross-sectional diagram of an embodiment of a tool 101 with the first segment 302 comprising the tip 350 of the tool 101. The tool 101 may comprise a base segment 301 comprising an attachment 203 to a drive mechanism (such as a rotating drum 102). The attachment 203 may be a shaft. The tool 101 may comprise first and second cemented metal carbide segments 302, 303 chemically bonded together at an interface 304, the first or second segment 302, 303 comprising a bonded region to a base segment 301. The cemented metal carbide segments 302, 303 may comprise tungsten, silicon, niobium, titanium, nickel, cobalt, or combinations thereof. The chemically bonded interface 304 may comprise a material comprising silver, gold, copper, nickel, palladium, boron, chromium, silicon, germanium, aluminum, iron, cobalt, manganese, titanium, tin, gallium, vanadium, indium, phosphorus, molybdenum, platinum, or combinations thereof. The preferred method of bonding is brazing.

The first segment 302 may comprise a first coefficient of thermal expansion (CTE) at least at its interfacial surface and the second segment 303 may comprise a second CTE at least at its interfacial surface, the second CTE being less than the CTE of the first segment 302. The first segment 302 may further comprise a cross-sectional thickness substantially equal to or greater than a cross-sectional thickness of the second segment 303 at the interface 304. In some embodiments, the first segment 302 comprises a greater outer diameter than the second segment 303. If the first segment's CTE is higher than the second segment's CTE, then the first segment's expansion proximate the interface may be greater than the second segment's expansion when brazing the two segments 302, 303 together. This also means that the first segment 302 may shrink more than the second segment 303 when cooling. It is believed that if the first segment's cross-sectional thickness and/or the cross-sectional area at the interface is less than the second segment's, the first segment 302 may put tension on a portion of the second segment 303. If, on the other hand, the first segment's cross-sectional thickness at the interface is greater than the second segment's, the first segment 302 may put the second segment 303 into compression at the interface. It is believed that compression may be more desirable than tension when bonding cemented metal carbide segments together.

A preferred method of controlling the CTE of both segments 302, 303 may be controlling the binder concentration in the cemented metal carbide segments 302, 303. The binder may often be cobalt or nickel. Preferably a higher concentration of cobalt is used to achieve a higher CTE. The first segment 302 may comprise a cobalt concentration of 6 to 35 weight percent and the second segment 303 may comprise a cobalt concentration of 4 to 30 weight percent. In a preferred embodiment, the first segment comprises 11 to 14 weight percent while the second segment comprises 4 to 7 weight percent.

The first or second segment may also comprise a region bonded to a superhard material 305 selected from the group consisting of diamond, natural diamond, polycrystalline diamond, cubic boron nitride, or combinations thereof. The superhard material 305 may be bonded by sintering, chemical vapor deposition, physical vapor deposition, or combinations thereof. The superhard material may reduce wear on the tool 101, which may increase the life of the tool 101.

An overhang 351 formed by the first segment having a greater cross-sectional thickness, may be filled with extruded braze material, which may help put the interface into compression, if the braze material has a higher CTE than the carbide segments. The larger diameter first segment 302 may also allow for a wider superhard material 305 which may reduce the impact felt by the second segment 303. A first segment 302 that has a substantially similar or greater diameter than the second segment 303 may reduce the wear felt by second segment 303.

In embodiments where the first segment comprises a cross sectional thickness substantially equal to a cross sectional thickness of the second embodiment, there may be no overhang. In such embodiments, it is believed that the first segment may still protect the second segment from wear.

Figure 4:
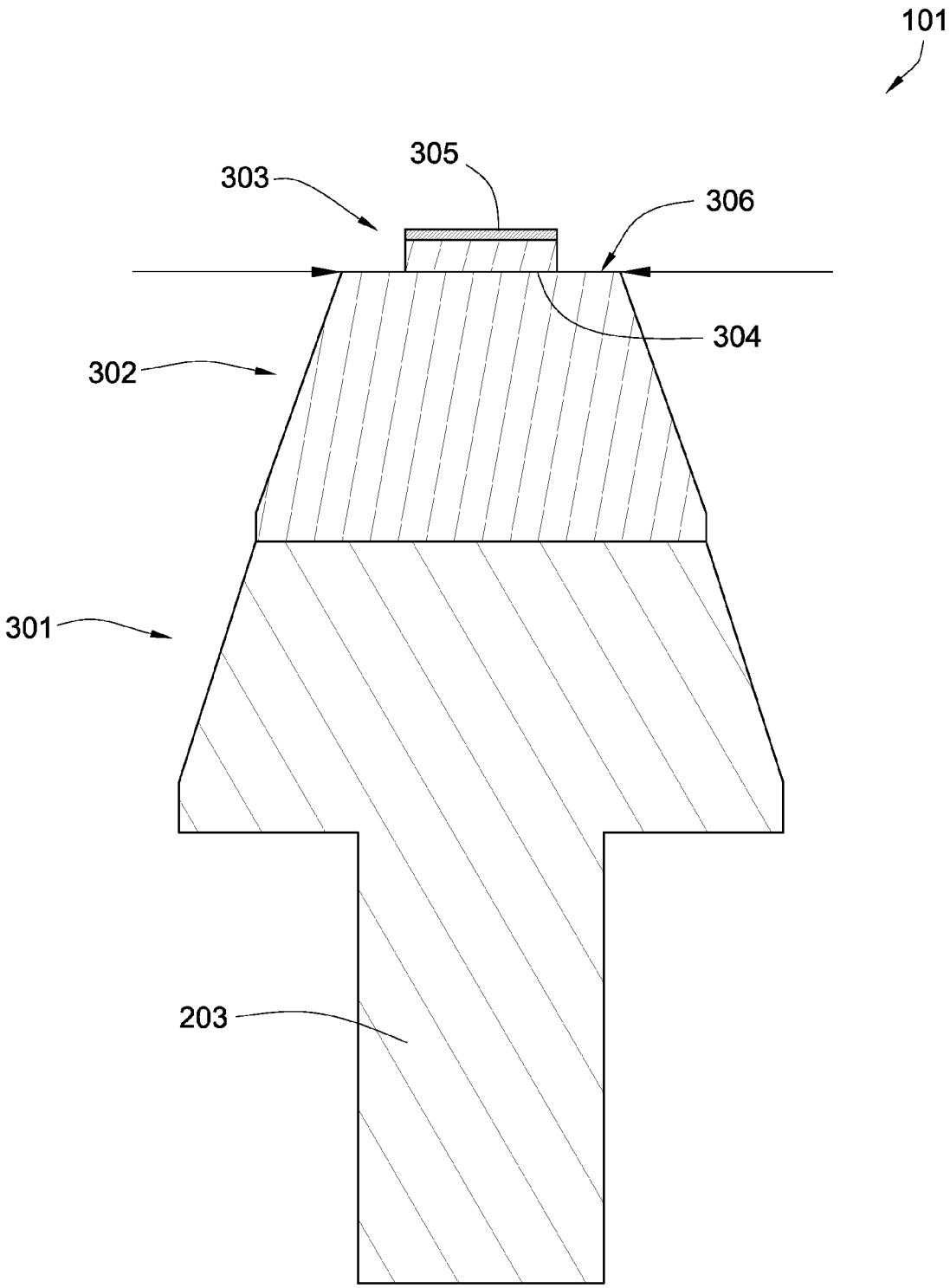
FIG. 4 is a cross-sectional diagram of an embodiment of a tool with the first segment being bonded to a base segment.

FIG. 4 is a cross-sectional diagram of an embodiment of a tool 101 with the first segment 302 bonded to a base segment and the second segment bonded to the superhard material. Additionally, FIGS. 3 and 4 show an interface 304 that is planar which makes it easier to braze the segments 302, 303 together and manufacture.

In such a configuration, surfaces of the tool 101 may be susceptible to high wear. Such a surface may be an edge 306 of the tool or it may be on the base segment 301 near the attachment 203. A durable coating (not shown) may cover surfaces susceptible to high wear. The durable coating may comprise diamond, polycrystalline diamond, cubic boron nitride, diamond grit, polycrystalline diamond grit, cubic boron nitride grit, or combinations thereof. The durable coating may be deposited by chemical vapor deposition; physical vapor deposition; blasting diamond grit, polycrystalline diamond grit, cubic boron nitride grit, or combinations thereof; sintering; or combinations thereof.

Figure 5:
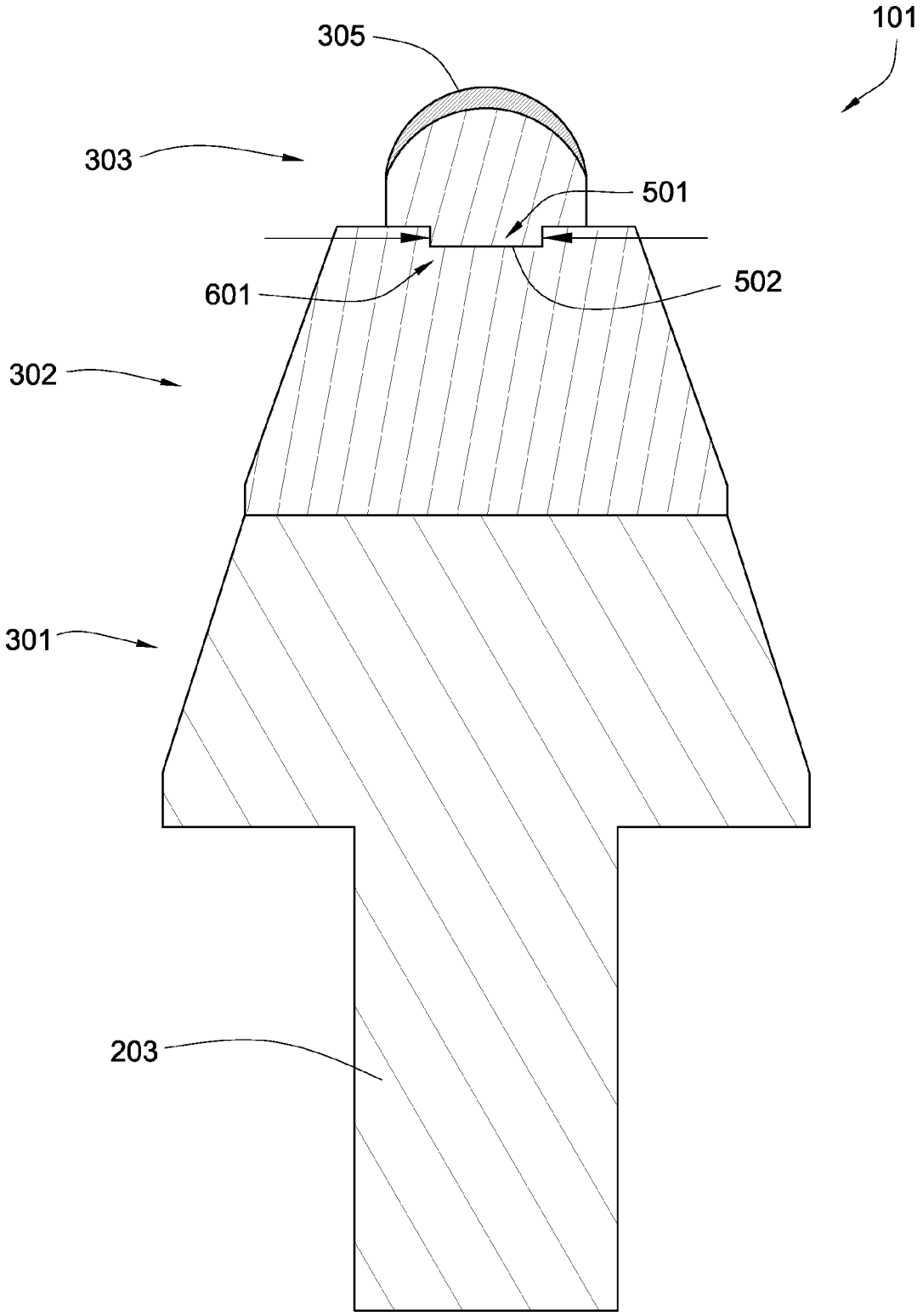
FIG. 5 is a cross-sectional diagram of an embodiment of a tool with a non-planar interface between first and second segments.
Figure 6:
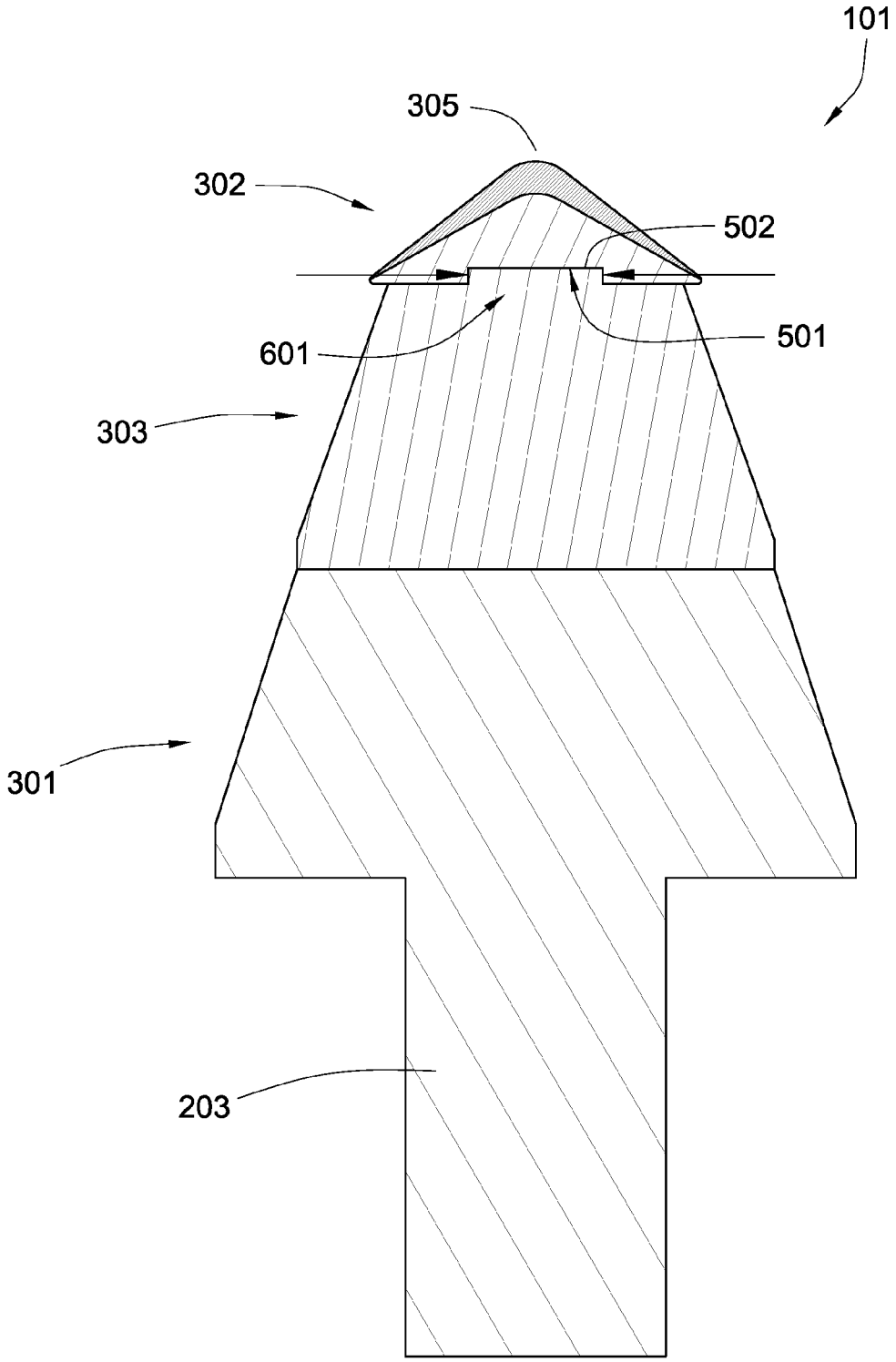
FIG. 6 is a cross-sectional diagram of another embodiment of a tool with a non-planar interface between first and second segments.

FIGS. 5 and 6 are cross-sectional diagrams of embodiments of a tool in which first and second segments 302, 303 comprise an interface that is non-planar. In FIG. 5, the first segment 302 is bonded to a base segment 301. A non-planar interface 601 between the first and second segments 302, 303 may be beneficial in increasing the interfacial surface that is brazed which may result in a stronger interface. In FIG. 6, the second segment 303 is bonded to a base segment 301. In FIGS. 5 and 6, the second segment 302 comprises a protrusion 501 which fits in a recess 502 of the first segment. After brazing, the first segment 302 may shrink and compress the protrusion 501.

Figure 7:
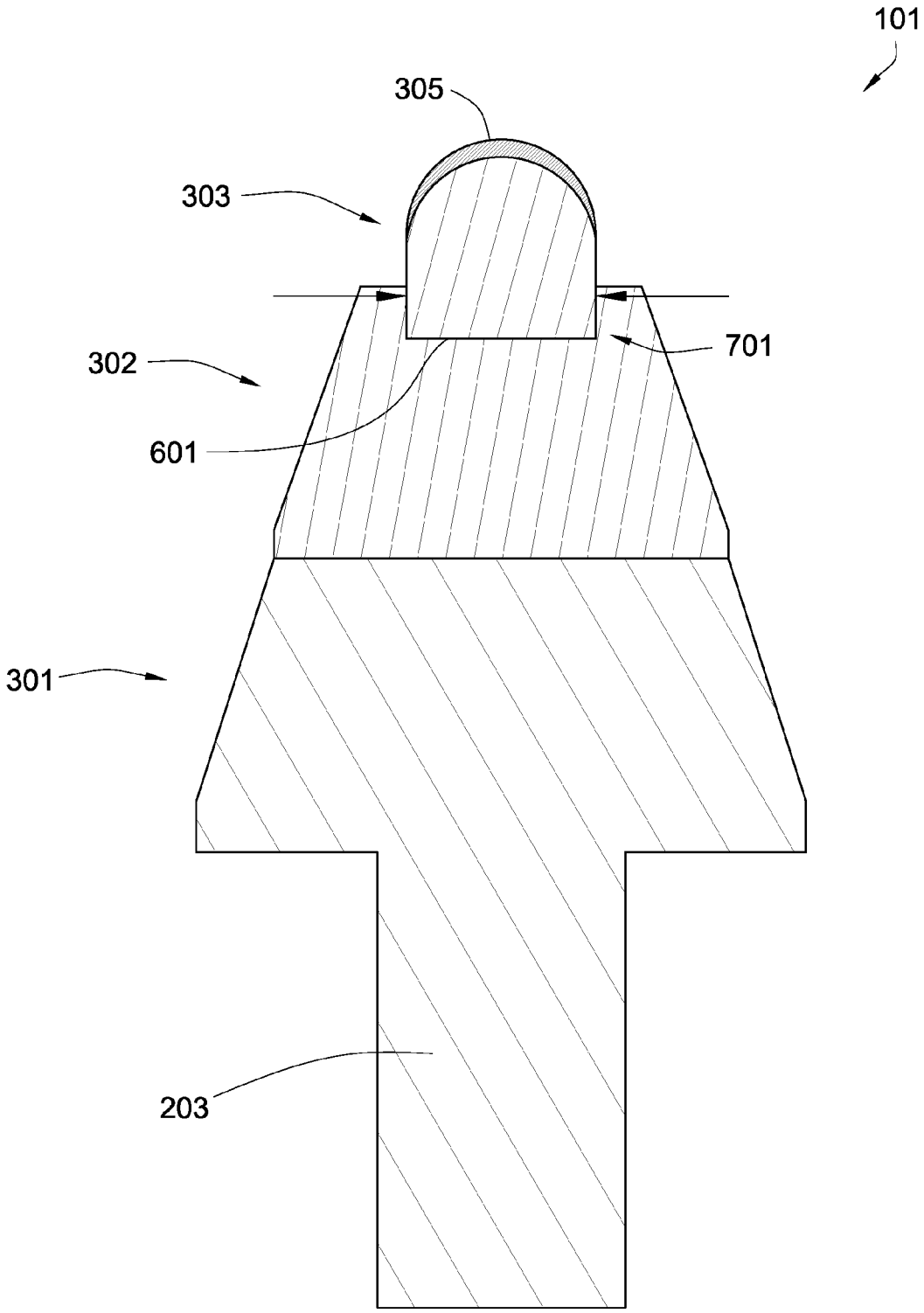
FIG. 7 is a cross-sectional diagram of an embodiment of a tool with a pocket in the tool's body adapted to receive a first or second segment.

FIG. 7 is a cross-sectional diagram of an embodiment of a tool 101 with a pocket 701 formed in the first segment 302 adapted to receive the second segment 303. The second segment 303 may be brazed into the pocket 701.

Figure 8:
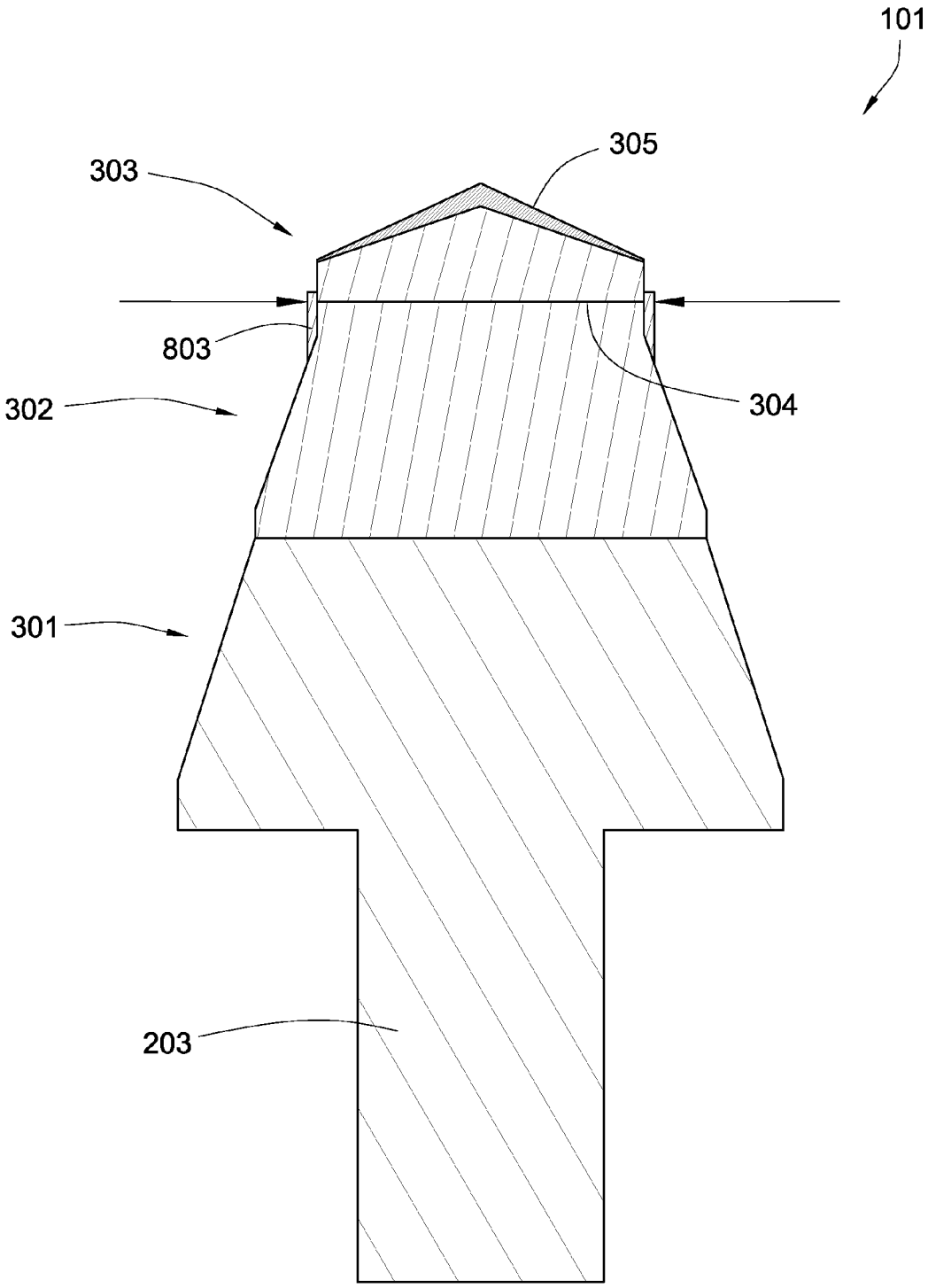
FIG. 8 is a cross-sectional diagram of an embodiment of a tool with a sleeve holding first and second segments under compression.

FIG. 8 is a cross-sectional diagram of an embodiment of a tool with a sleeve 803 holding first and second segments 801, 802 under compression. A wear-resistant tool 101 may comprise first and second cemented metal carbide segments 302, 303 bonded together at an interface 304. The interface 304 may be held under compression by a material comprising a higher CTE than the CTE of the segments 302, 303. In alterative embodiments, the first segment 302 comprises the material with a higher CTE. The sleeve of FIG. 8 may comprise a cemented metal carbide with a higher binder concentration than the first or second carbide segments.

The sleeve 803 may be brazed around the interface 304. Because the sleeve 803 may comprise the higher CTE it will expand more when brazed to the interface 304, then shrink putting the interface 304 into compression. In some embodiment, the sleeve 803 may be thermally expanded before being placed around the interface 304, then allowed to cool. In such an embodiment, the sleeve may not need to be brazed to the tool 101. The sleeve 803 may comprise tungsten, silicon, niobium, titanium, nickel, cobalt, carbide, or combinations thereof.

Figure 9:
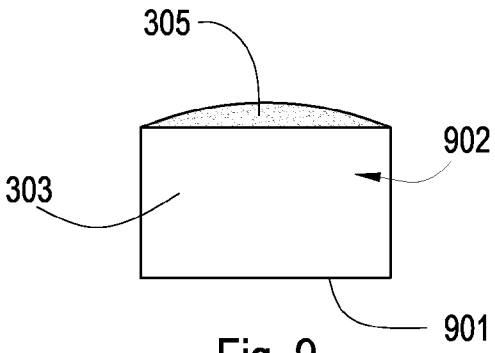
FIG. 9 is a cross-sectional diagram of an embodiment of a first segment and a superhard material bonded to the first segment.
Figure 10:
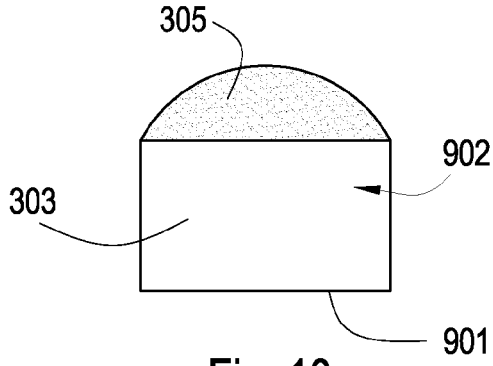
FIG. 10 is a cross-sectional diagram of another embodiment of a first segment and a superhard material bonded to the first segment.
Figure 11:
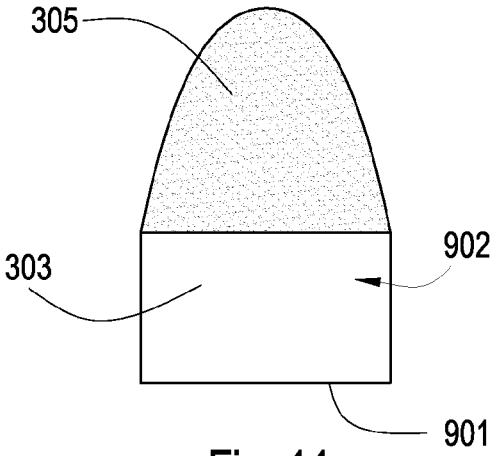
FIG. 11 is a cross-sectional diagram of another embodiment of a first segment and a superhard material bonded to the first segment.
Figure 12:
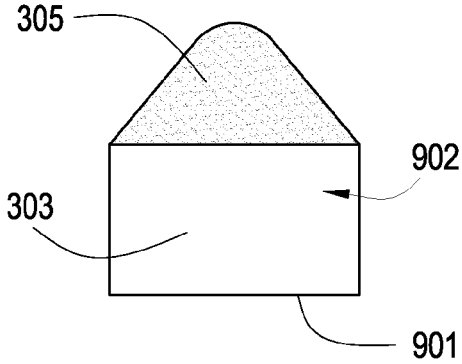
FIG. 12 is a cross-sectional diagram of another embodiment of a first segment and a superhard material bonded to the first segment.
Figure 13:
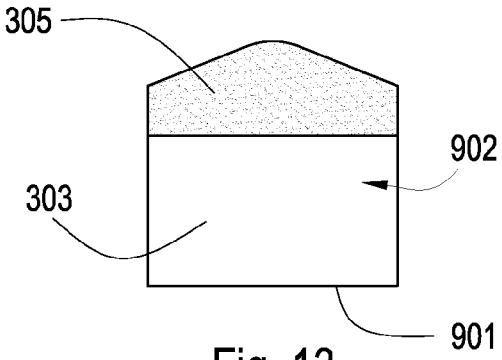
FIG. 13 is a cross-sectional diagram of another embodiment of a first segment and a superhard material bonded to the first segment.
Figure 14:
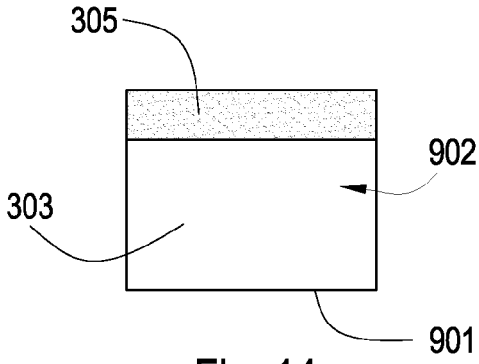
FIG. 14 is a cross-sectional diagram of another embodiment of a first segment and a superhard material bonded to the first segment.

FIGS. 9 through 14 are cross-sectional diagrams of various embodiments of a first segment and a superhard material bonded to the first segment. FIG. 9 shows a first segment 302 bonded to a superhard material 305 comprising a rounded geometry. FIG. 10 shows a first segment 302 bonded to a superhard material 305 comprising a domed geometry. FIG. 11 shows a first segment 302 bonded to a superhard material 305 comprising a conical geometry. FIG. 12 shows a first segment 302 bonded to a superhard material 305 comprising a semi-rounded geometry. FIG. 13 shows a first segment 302 bonded to a superhard material 305 comprising a pointed geometry. FIG. 14 shows a first segment 302 bonded to a superhard material 305 comprising a flat geometry.

Each geometry may change the tool's 101 cutting properties. A pointed geometry may allow for more aggressive cutting. While a rounded geometry may reduce wear by distributing stresses and make cutting less aggressive.

The first segment 302 may comprise a region proximate the interfacial surface 901 comprising a higher concentration of binder than a distal region 902 of the first segment 302. The metal may be a binder, such as cobalt and/or nickel, which increases the segment's CTE. In such a segment 302, heat from brazing may more easily expand the segment in the region proximate the interfacial surface 901 than in the distal region 902 which would be proximate the superhard material. This may be beneficial in reducing the stresses on the superhard material 305 during brazing in that the carbide segment proximate the superhard material 305 may expand less and leave less residual stress between the carbide and the superhard material.

Figure 15:
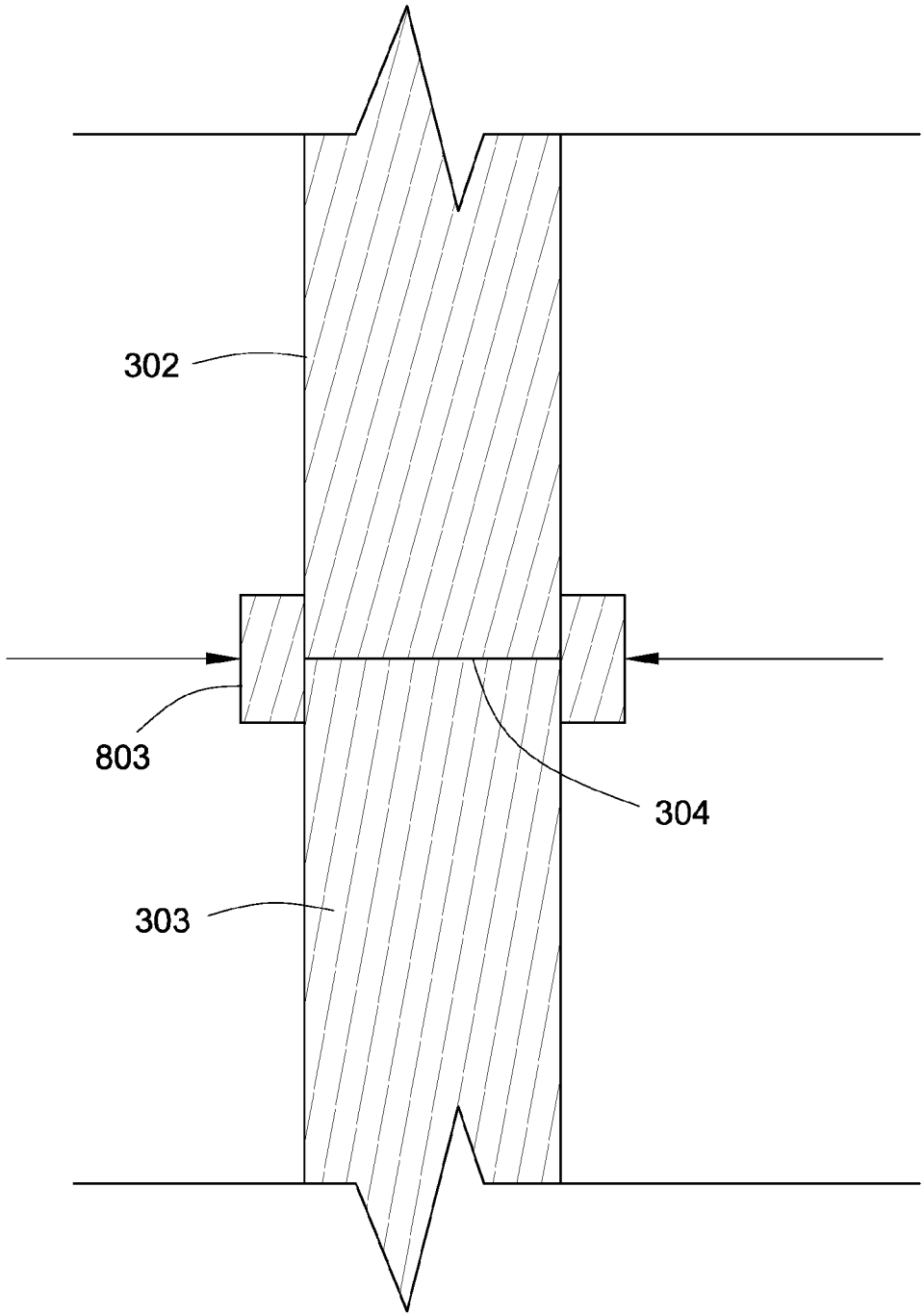
FIG. 15 is a cross-sectional diagram of an embodiment of first and second segments being held under compression by a sleeve.
Figure 16:
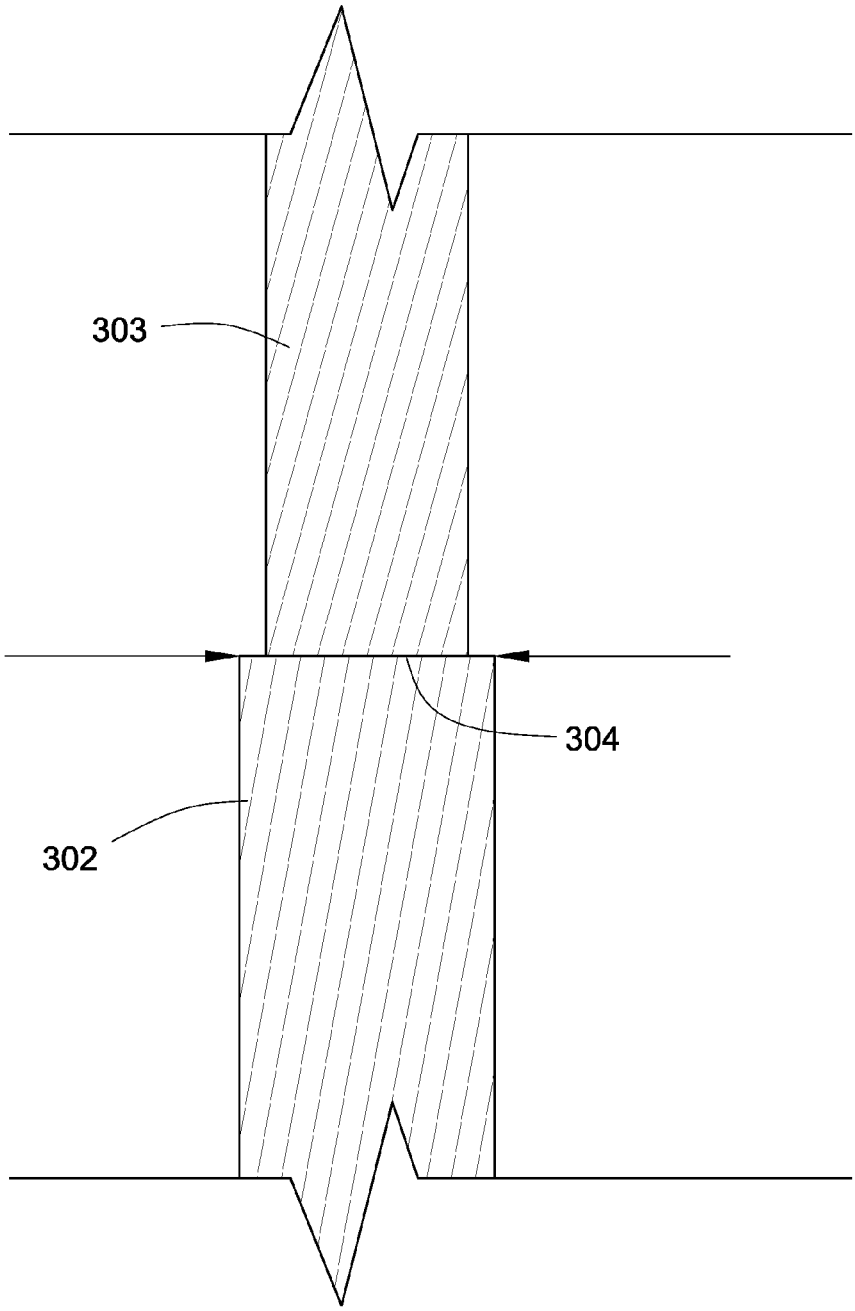
FIG. 16 is a cross-sectional diagram of an embodiment of first and second segments.

FIG. 15 is a cross-sectional diagram of an embodiment of first and second segments being held under compression by a sleeve and FIG. 16 is a cross-sectional diagram of an embodiment of first and second segments. Superhard materials 302 bonded to tools have many applications. The tool 101 may be selected from the group consisting of drill bits, asphalt picks, mining picks, hammers, indenters, shear cutters, indexable cutters, and combinations thereof. In FIG. 15, a sleeve 803 is used to bond two segments of a hammer, bit, pick, or cutter together. FIG. 16 discloses bonding a first segment 302 with a cross-sectional thickness at the interface 304 greater than the second segment's, the first segment 302 also comprising a higher CTE than the second segment 303.

Figure 17:
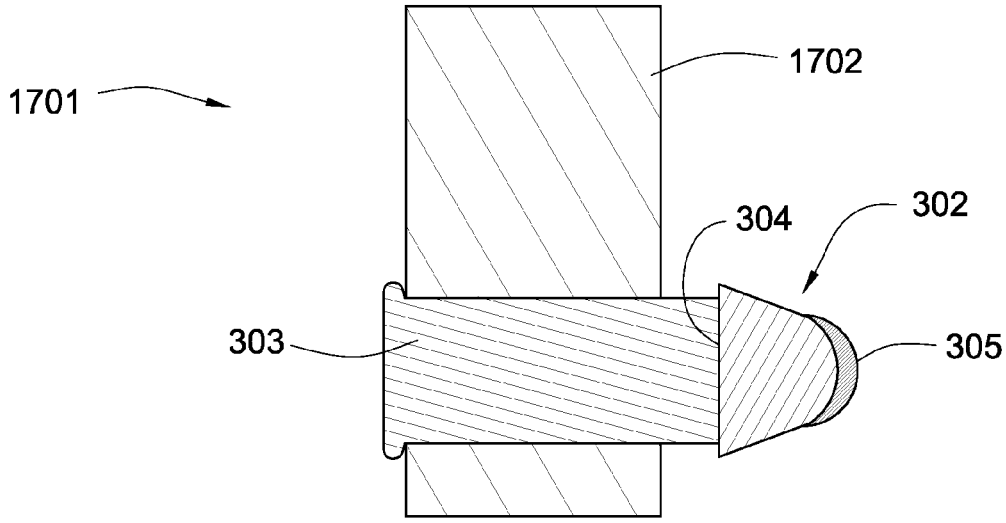
FIG. 17 is a cross-sectional diagram of an embodiment of an attack tool.
Figure 18:
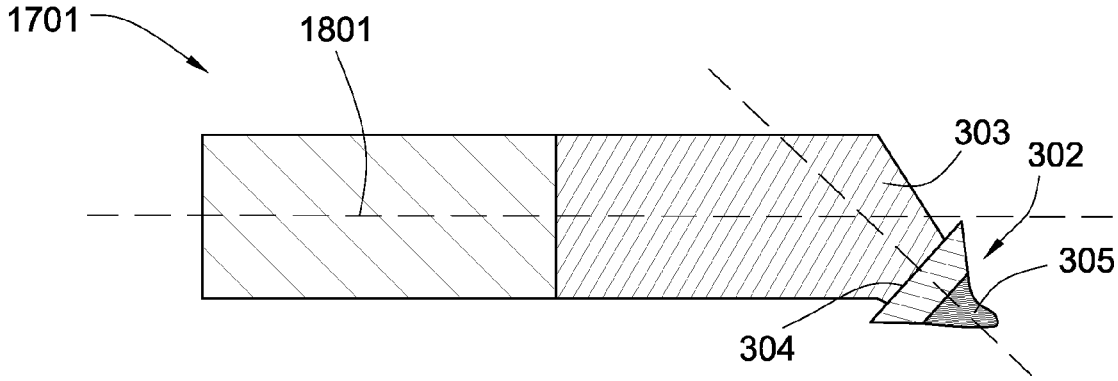
FIG. 18 is a cross-sectional diagram of another embodiment of an attack tool.
Figure 19:
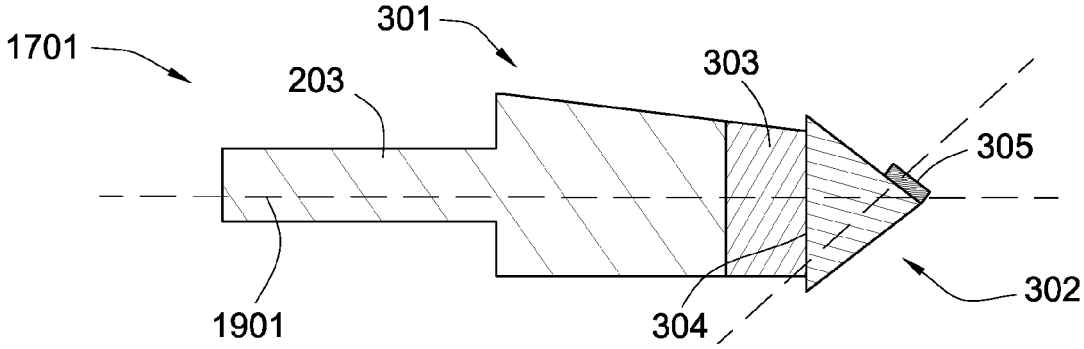
FIG. 19 is a cross-sectional diagram of another embodiment of an attack tool.

FIGS. 17-19 are cross-sectional diagrams of various embodiments of attack tools 1701 that are adapted to not rotate within the holders attached to a driving mechanism, such as a rotating drum. Each of the tools may comprise a base segment bonded to either the first or second carbide segment. The base segment 301 may comprise steel, a cemented metal carbide, or other metal. FIG. 17 discloses a blunt superhard material bonded to the first carbide segment. FIG. 18 discloses a tool with an asymmetric geometry. The tool of FIG. 18 comprises a second segment that is adapted for connection with a holder. The first carbide segment is also tilted from 1 to 75 degrees off a central axis 1801 of the tool. The superhard material is also adapted to engage the pavement at a positive rake angle. FIG. 19 discloses a tool with a superhard material tilted from 1 to 75 degrees off of the central axis 1901. The superhard material of FIG. 19 is adapted to engage the pavement at a negative rake angle.

What is claimed is:

1. A wear-resistant tool, comprising:

first and second cemented metal carbide segments being brazed together at a planar interface;

the first segment being bonded to a diamond material opposite the planar interface and the second segment being bonded opposite the planar interface to a steel base segment with a shank;

the first segment comprising a first coefficient of thermal expansion at the planar interface and the second segment comprising a second coefficient of thermal expansion at the planar interface less than the coefficient of thermal expansion of the first segment; and the first segment further comprising a cross-sectional thickness at the interface greater than a cross-sectional thickness of the second segment at the planar interface such that an overhanged is formed between the carbide segments.

2. The tool of claim 1, wherein the chemically bonded planar interface comprises a material comprising silver, gold, copper, nickel, palladium, boron, chromium, silicon, germanium, aluminum, iron, cobalt, manganese, titanium, tin, gallium, vanadium, indium, phosphorus, molybdenum, platinum, or combinations thereof.

3. The tool of claim 1, wherein the first segment comprises a cobalt concentration of 6 to 35 percent.

4. The tool of claim 1, wherein the second segment comprises a cobalt concentration of 4 to 30 percent.

5. The tool of claim 1, wherein the wear resistant cutting tool is selected from the group consisting of drill bits, asphalt picks, mining picks, hammers, indenters, shear cutters, indexable cutters, and combinations thereof.

6. The tool of claim 1, wherein the cemented metal segments comprise tungsten, silicon, niobium, titanium, nickel, cobalt, or combinations thereof.

7. The tool of claim 1, wherein the diamond material is selected from the group consisting of natural diamond, polycrystalline diamond, or combinations thereof.

8. The tool of claim 1, wherein a durable coating covers surfaces of the base segment.

9. The tool of claim 1, wherein the first segment comprises a region proximate the interface comprising a higher concentration of metal than a distal region of the first segment.

10. The tool of claim 1, wherein the tool comprises an asymmetric geometry.

11. The tool of claim 1, wherein the first carbide segment is titled off a central axis of the tool.

12. The tool of claim 1, wherein the superhard material comprises a conical geometry.

13. The tool of claim 1, wherein the overhang is filled with an extruded braze material.

14. The tool of claim 1, wherein the tool is an asphalt pick.

15. the tool of claim 1, wherein the asphalt pick is adapted to not rotate within a holder attached to a rotating drum.

* * * * *